United States Patent [19]

Steinback

[11] 4,322,918

[45] Apr. 6, 1982

[54] ABRASIVE GRINDING MACHINE

[75] Inventor: Clarence I. Steinback, Edina, Minn.

[73] Assignee: Acrometal Products, Inc., Minneapolis, Minn.

[21] Appl. No.: 152,799

[22] Filed: May 23, 1980

[51] Int. Cl.[3] ..... B24B 21/04

[52] U.S. Cl. ..... 51/138; 51/328

[58] Field of Search ..... 51/76 R, 137, 138, 139, 51/328

[56] References Cited

U.S. PATENT DOCUMENTS

| | | | |
|---|---|---|---|
| 1,804,537 | 5/1931 | Meacher . | |
| 2,227,865 | 1/1941 | Scott | 51/138 |
| 3,269,065 | 8/1966 | Nyland . | |
| 3,499,249 | 3/1970 | Aberle | 51/76 R |
| 3,555,740 | 1/1971 | Schaller | 51/138 |
| 3,654,738 | 4/1972 | Sternal . | |
| 3,701,219 | 10/1972 | Sternal . | |

FOREIGN PATENT DOCUMENTS

| | | | |
|---|---|---|---|
| 924256 | 2/1955 | Fed. Rep. of Germany | 51/138 |

*Primary Examiner*—Harold D. Whitehead

*Attorney, Agent, or Firm*—Merchant, Gould, Smith, Edell, Welter & Schmidt

[57] ABSTRACT

An abrasive grinding machine is particularly suited for the removal of slag surrounding the edges of metal workpieces torch-cut from flat stock. The grinding machine includes a longitudinal conveyor that is tilted about a longitudinal axis so that one longitudinal edge is lower than the lower. A fence is positioned along the lower edge to retain and guide workpieces as they are carried forward by the conveyor. A grinding head consists of an endless grinding belt carried and driven by upper and lower parallel rollers. The lower contact roller is positioned in spaced relation to the upper flight of the conveyor. The contact roller is positioned with its rotational axis at a predetermined acute angle measured clockwise from the forward line of conveyor movement. The rollers are driven so that the grinding belt moves toward the fence, creating a major component of movement perpendicularly toward the fence and a minor component of movement in the direction of conveyor belt movement. In an alternative embodiment, the contact roller is positioned at an acute angle that is measured counterclockwise from the line of forward conveyor movement. This produces a major component of movement perpendicularly toward the fence and a minor component of movement opposite the direction of forward conveyor movement. In either case, the grinding head is constructed and positioned so that it provides the additional function of a pinch roller, permitting small workpieces to be efficiently and uniformly ground.

21 Claims, 5 Drawing Figures

ABRASIVE GRINDING MACHINE

TECHNICAL FIELD

This invention relates to the field of grinding, and more particularly to grinding machines for removing the slag surrounding the edges of metal workpieces torch-cut from flat stock of appropriate thickness and for use in similar applications.

BACKGROUND OF THE INVENTION

One method of fabricating machines and other articles from metal involves the torch-cutting of components from metal plate. Although this method is reasonably efficient, the component produced in this manner is surrounded at its edges by rough ridges of slag which must be removed to restore the surface flatness and appearance of the component prior to further assembly.

Slag removal is conventionally accomplished by unskilled workers using chipping hammers or hand grinders. An improvement on this manual approach is the slag grinding machine, in which a horizontal conveyor moves the workpieces relative to a grinding head. The grinding head consists of a wide, endless abrasive belt driven around upper and lower rollers, the lower of which is disposed in overlying relation to the conveyor with its axis of rotation substantially perpendicular to the line of conveyor movement. The abrasive belt, in passing around the lower roller, defines a line or region of abrasive contact with the workpieces as they pass between the abrasive belt and conveyor. The space between the belt and conveyor is adjusted based on the thickness of the workpiece.

The abrasive belt is necessarily moved against the direction of conveyor movement to effect slag removal, since abrasive belt movement in the same direction as the conveyor would simply result in projecting the workpieces forward at high speed with little or no grinding. Because of this direction of abrasive belt movement, it is also necessary to employ transversely disposed, driven pinch rollers disposed in overlying relation to the conveyor belt and upstream of the grinding head to insure that the workpieces are continuously and uniformly fed to the abrasive belt.

The slag grinding machines of this type are highly efficient relative to the manual approach of slag removal and represent a considerable saving of labor time and cost in prevention. However, because there is a practical limitation on the closeness of the pinch rollers to the grinding head, there is also a lower limit to the size of workpieces that can be efficiently handled. If the workpiece has a smaller dimension than the distance between the pinch rollers and grinding head, it will not be driven through the grinding area; and, since the abrasive belt moves in a direction against conveyor movement, the small workpiece can become stalled between the two, unable to move forward. This may result in jamming of the machine since following workpieces may likewise be unable to proceed forward.

SUMMARY OF THE INVENTION

The invention is thus directed to a slag grinding machine that is specifically designed to effectively and efficiently remove the slag from small workpieces. The machine employs a flat, endless conveyor belt that moves longitudinally forward relative to a grinding head. The upper flight of the conveyor is tilted about its longitudinal axis, rather than lying entirely in a horizontal plane as in prior art devices. A longitudinal fence or guide bar is mounted to the machine frame along the lower longitudinal edge of the conveyor belt. Small, individual workpieces tend to slide down the tilted planer surface of the conveyor belt to the fence, where they are thereafter guided toward the grinding head.

The grinding head also comprises an endless abrasive belt driven around upper and lower rollers. The rotational axes of these rollers are disposed in parallel relation to the plane of the conveyor bed, but they are disposed at an acute angle, preferably 10°–30°, relative to the line of conveyor movement. Accordingly, the region of the abrasive contact, as defined by the abrasive belt as it passes around the lower drive roller, is disposed more longitudinally of the conveyor belt, but also at the aforesaid acute angle.

The upper and lower rollers are driven so that the abrasive belt moves toward the longitudinal fence. As such, one component of abrasive belt movement is perpendicularly toward the fence, whereas the other is with the line of conveyor movement. Consequently, the small workpiece is wedged toward the fence by abrasive belt movement, but at the same time is urged forward by the conveyor and abrasive belts. As a result, the slag on the workpiece is effectively and efficiently removed, even though no pinch rollers are employed.

Another advantage of the improved configuration is that, due to the angular positioning of the abrasive belt rollers, the region of abrasive contact is much longer than with the rollers disposed perpendicularly of the conveyor belt. As such, more mineral on the abrasive belt is exposed. This results in extended abrasive belt life, or permits the belt to do increased work in comparison to prior art machines with the workpiece feed rate increased.

In an alternative embodiment, the grinding head is disposed at a modified angle. In the first embodiment, the grinding head is disposed at an acute angle which is measured clockwise relative to a line extending in the direction of forward conveyor movement. In the alternative embodiment, the grinding head is positioned at an acute angle that is measured counterclockwise from the line of forward conveyor movement. Rotation of the grinding head belt, however, continues toward the fence. With this angular modification, the primary component of abrasive belt movement is still perpendicularly toward the fence, but the minor component of movement is against the line of conveyor movement.

This embodiment is particularly useful if the workpiece slag is quite heavy, or where the desired application is for removal of a substantial amount of material (e.g., 0.020 or 0.030 inches) from the entire surface of the workpiece. Under these circumstances, positioning of the grinding head in this manner will prevent the workpieces from being forced ahead prematurely before the operation is satisfactorily completed.

DESCRIPTION OF THE PREFERRED EMBODIMENT

Figure 1:
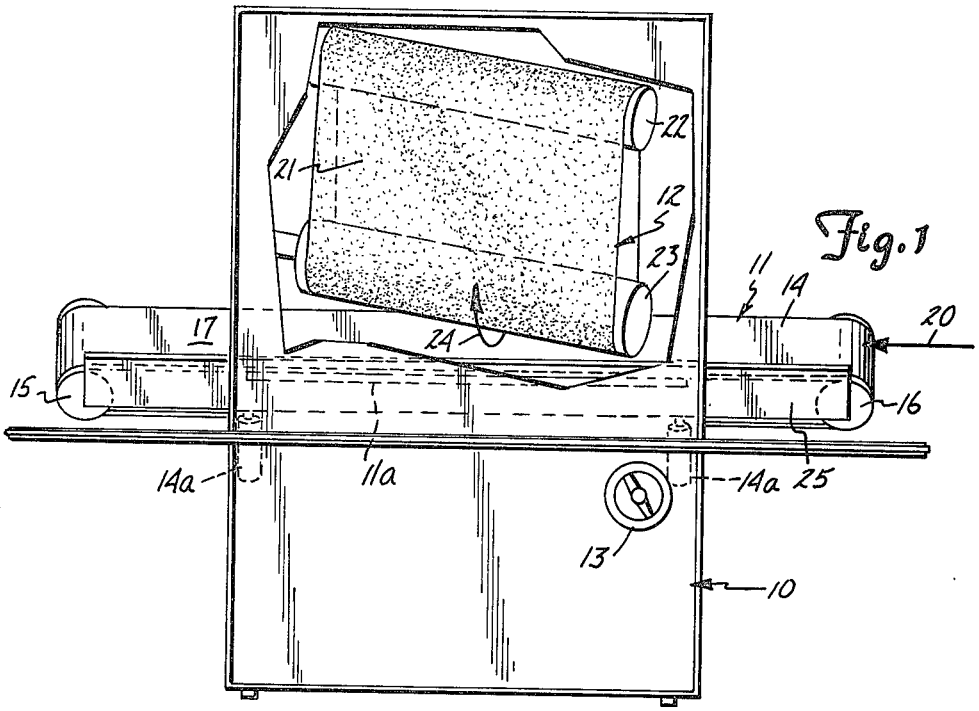
FIG. 1 is a side elevation of a slag grinding machine embodying the invention, parts being broken away for clarity of illustration.

In the drawings the invention is shown to comprise a frame 10, a longitudinal conveyor 11, and a grinding head 12, all shown somewhat schematically. Conveyor 11 is mounted in frame 10, in any suitable fashion, for vertical adjustment by operation of a hand wheel 13. Preferably, the vertical adjustment takes the form of a plurality of screw jacks 14*a* (FIGS. 1 and 2) that are mounted directly to the frame 10, and to which the conveyor 14 is mounted. The jacks 14*a* are interconnected by a conventional linkage to hand wheel 13 so that hand wheel movement affects simultaneous and identical movement of the jacks 14*a*.

The conveyor comprises a belt 14 passing around rollers 15 and 16 to have a working surface 17 which is flat. As particularly shown in FIG. 2, the flat surface 17 of conveyor belt 14 is not horizontally disposed. Rather, it is tilted about its longitudinal axis to an angle A. The angle A is not critical, and is chosen to cause the workpiece to slide to the fence 25 before it reaches the grinding head 12. The elevation of the belt 14 does not change from its inlet end to its outlet end. Means for varying the angle A of belt 14 may be provided if desired.

Conventional motor means, not shown, are provided for causing longitudinal movement of the belt in the direction of arrow 20. The conveyor drive typically consists of variable diameter driving and driven sheaves that are belt connected, and may be adjusted to vary the linear velocity of the conveyor belt 14.

Figure 3:
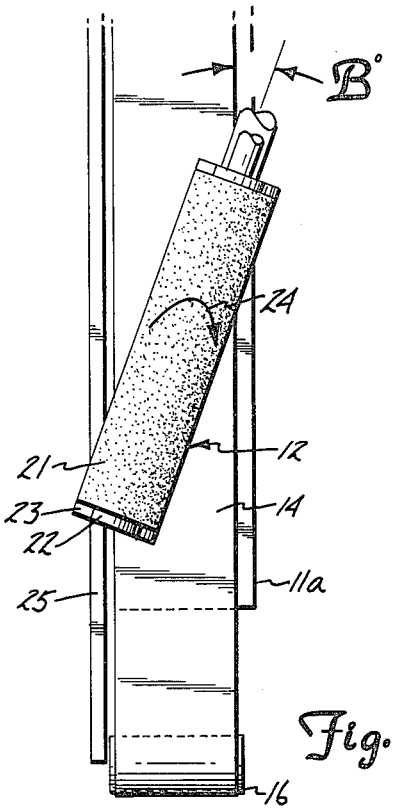
FIG. 3 is a fragmentary view along the line 3—3 of FIG. 2.

Grinding head 12 comprises an endless abrasive belt 21 carried on parallel upper and lower rollers 22 and 23 that are rotatably mounted on frame 10. The roller 23, which is referred to as the contact roller, is driven by a constant speed motor through a belt drive, not shown. Roller 23 is of hard durometer material, so that the abrasive belt defines a working edge or region of abrasive contact disposed in overlying relation to the surface 17 of conveyor 11. However, the durometer of roller 23 may be varied as is known in the art to vary the aggressiveness of the grind. The working edge or region lies substantially in a plane that is parallel to the conveyor surface. As shown in FIG. 3, the axis of rollers 23 is angularly disposed relative to the line of conveyor movement by an acute angle B, which is preferably 10°–30°. The abrasive belt is accordingly several times as wide as the conveyor belt. Movement of the abrasive belt 21 about roller 23 is in the direction shown by arrow 24.

Preferably, grinding head 12 is mounted to the frame 10 in a stationary position. It could also be mounted in a floating position by air loading in a conventional manner, so that the grinding head 12 yields somewhat to the workpiece as it moves through.

Figure 2:
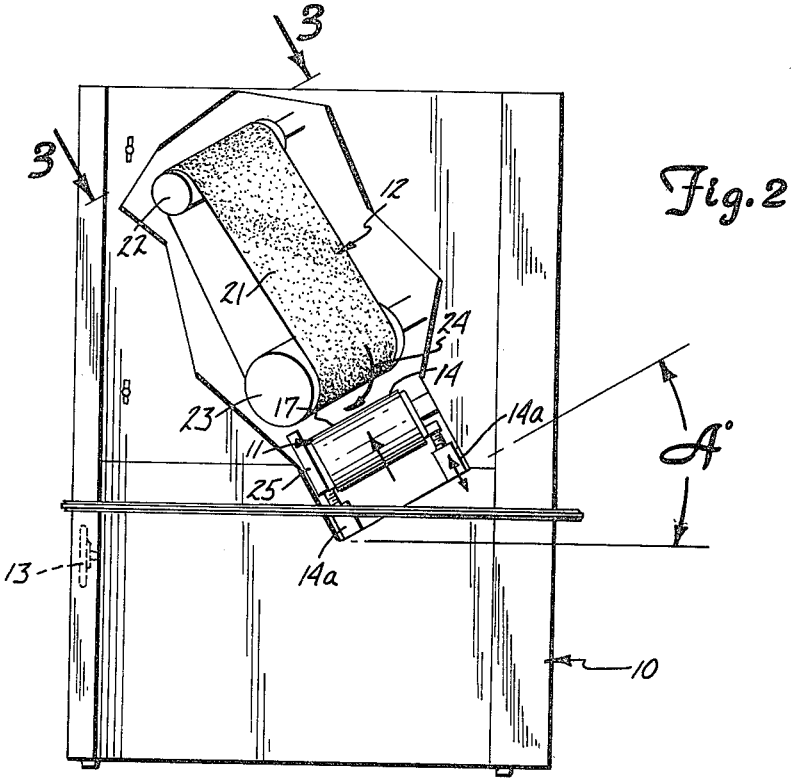
FIG. 2 is a front elevation of the slag grinding machine of FIG. 1, parts likewise being broken away.
Figure 4:
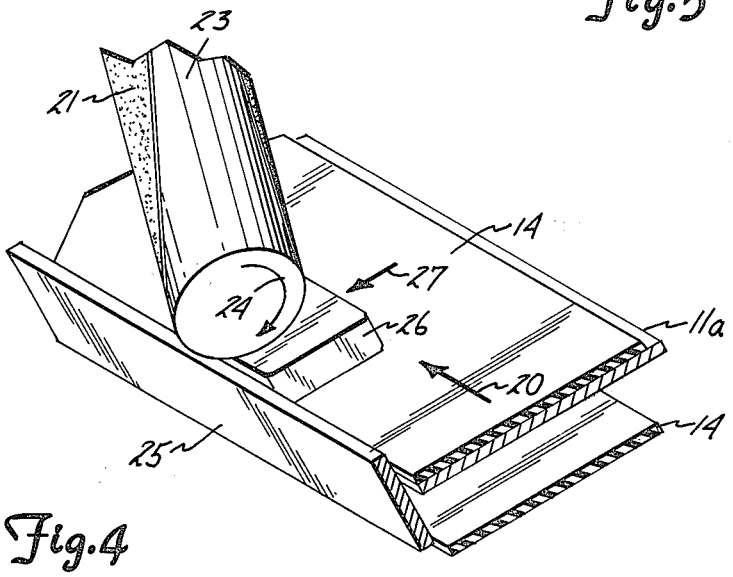
FIG. 4 is a fragmentary view in perspective of the invention operating on a workpiece.

The conveyor 11 is provided with a solid bed 11*a* to back the conveyor belt 14 over at least the working area; i.e., the effective length of the abrasive belt 21. As shown in FIGS. 1, 3, and 4, the solid bed 11*a* is conventionally disposed underneath the upper flight of the conveyor belt 14.

A fence 25 is mounted to extend along the lower longitudinal edge of conveyor 14, rising beyond its surface 17 an amount permitting the workpieces to be retainably guided as they are conveyed past the grinding head 12. The fence 25 is mounted to the machine frame 10 in a conventional manner not shown, to be stationary with the grinder head. Accordingly, the conveyor moves up and down relative to both the fence 25 and the grinding head 12.

OPERATION

In use, belts 14 and 21 are set in operation, wheel 13 is turned to provide a spacing between the belts based on the workpiece thickness, and workpieces are fed into the machine by laying them on surface 17 of belt 14 at its right-hand end as seen in FIG. 1, near roller 16. If one edge of the workpiece does not initially contact fence 25, the piece quickly slides transversely down belt 14 to contact the fence under the influence of gravity, or by contact with the abrasive belt 21.

The workpiece is carried forward by conveyor belt 14 until its upper surface comes into engagement with abrasive belt 21. Because of the angle B between the axis of roller 23 and the direction 20 of workpiece 26 (see FIG. 4), the principal component of force exerted by the abrasive belt 21 on the workpiece is toward fence 25, as suggested by the arrow 27. There is however a small component of force between the abrasive belt and the workpiece acting in the direction of belt movement, so that the abrasive belt performs not only its grinding function, but also the function of a pinch roller as well. The workpiece moves through the machine at substantially the speed of the conveyor, slag and pits being removed from its upper surface in accordance with the setting of hand wheel 13. After passing through the machine, the workpieces are discharged at the left-hand end of the conveyor near roller 15.

Because of the angle B between the abrasive belt axis and the direction of movement of the pieces, the edge or region of abrasive contact to which the workpieces are exposed is much longer than an abrasive belt that is disposed perpendicularly of the line of conveyor movement. Because of this, more mineral on the abrasive belt is exposed to the workpieces during the slag grinding process. As a result, the life of abrasive belt 21 is extended relative to belts on conventional machines. Alternatively, the speed of conveyor 11 may be incresed to get greater throughput of workpieces for the same period of belt life.

It will also be evident that the workpiece will be ground so long as it is contacted by the region of abrasive contact. Further, because this region itself provides the function of a pinch roller, the machine will handle the workpieces that vary in size from extremely small to workpieces of any length, so long as their width is no greater than the effective width of the abrasive belt.

From the above, it will be evident that the invention enables the slag grinding of workpieces of any length, with good life for abrasive belts used and improved output of workpieces. The machine is not limited to slag grinding, and may serve other functions such as reducing a plurality of workpieces to a single uniform thickness.

ALTERNATIVE EMBODIMENT

Figure 5:
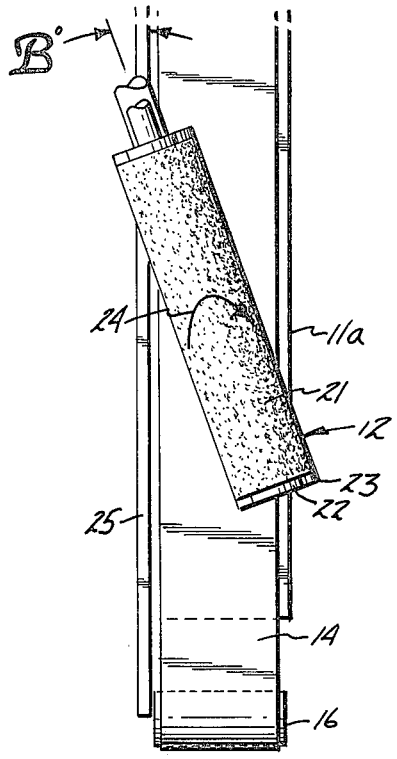
FIG. 5 is a view of an alternative embodiment similar to FIG. 3 with a modification to the grinding head angle.

An alternative embodiment of the invention is shown in FIG. 5, in which the reference numerals are identical for components which are the same as those of the first embodiment.

The sole difference resides in the angular position of the grinding head 12. In the first embodiment (FIG. 3), the angle B is measured clockwise from the forward line of conveyor movement, and produces a major component of abrasive belt movement perpendicularly toward the fence 25 and a minor component of movement with the line of conveyor movement.

In the alternative embodiment of FIG. 5, the rollers 22, 23 are disposed at an angle B′ which is measured in a counterclockwise direction from the line of forward conveyor movement. Rotation of the rollers 22, 23, however, is in the same direction.

As arranged, the major component of abrasive belt movement continues to be perpendicularly toward the fence 25. However, the minor component of abrasive belt movement is in a direction opposite the line of conveyor belt movement.

The embodiment of FIG. 5 is preferred where workpiece slag is particularly heavy, or where it is desired to remove a substantial amount of material (e.g., 0.020 or 0.030 inches) from the entire surface of a workpiece. Under these circumstances, any minor component or force which moves with the line of conveyor belt movement might tend to move the workpiece forward too quickly, particularly since the grinding head is set at a deep level of removal. Thus, the grinding head has a tendency to "walk up" that portion of the material which it is attempting to remove.

However, with the grinding head disposed at the angle B′, the minor component of movement runs against the forward line of conveyor movement, thus resisting premature forward movement. Even with the grinding head 12 set at an aggressive rate of removal, it will be appreciated that the contact roller 23 is rotating in a manner so that it "walks down" the material to be removed. This precludes climbing of the grinding head 12, and results in successful operation even when the rate of material removal is significant.

Operation of the alternative embodiment of FIG. 5 is otherwise the same, with the region of abrasive contact providing the function of a pinch roller.

What is claimed:

1. An abrasive grinding machine comprising:

(a) frame means;

(b) endless conveyor belt means carried by the frame means, the conveyor belt means having an upper flight which defines a substantially flat movable surface for carrying workpieces thereon, the movable surface having first and second edges and a predetermined longitudinal axis;

(c) means for driving the conveyor belt means so that the movable surface carries workpieces therealong;

(d) stationary fence means associated with the conveyor belt means and extending along the first edge of the movable surface for retainably guiding transported workpieces;

(e) an endless abrasive belt;

(f) means for mounting the abrasive belt for abrasive movement relative to said movable surface, the mounting means comprising a contact roller rotatably carried by the frame means in parallel, spaced relating to the movable surface, the contact roller having a rotational axis that is disposed at an acute angle relative to the longitudinal axis of the movable surface;

(g) and means for rotatably driving the contact roller so that during its abrasive movement the endless abrasive belt moves in a direction toward the fence means.

2. The abrasive grinding machine defined by claim 1, wherein the contact roller has first and second ends, the first end being disposed proximate the first edge of the movable surface, and the second end being disposed downstream of the first end.

3. The abrasive grinding machine defined by claim 2, wherein the second end of the contact roller is disposed proximate the second edge of the movable surface, whereby the roller has an effective width substantially corresponding to the width of the movable surface.

4. The abrasive grinding machine defined by claim 1, wherein the contact roller has first and second ends, the first end being disposed proximate the second edge of the movable surface, and the second end being disposed downstream of the first end.

5. The abrasive grinding machine defined by claim 4, wherein the second end of the contact roller is disposed proximate the first edge of the movable surface, whereby the contact roller has an effective width substantially corresponding to the width of the movable surface.

6. The abrasive grinding machine defined by claim 1, wherein the mounting means further comprises a second roller disposed above and in parallel relation to the contact roller, the endless abrasive belt encircling the contact and second rollers.

7. The abrasive grinding machine defined by claim 1, wherein the first and second edges of the movable surface are disposed in parallel relation to horizontal.

8. The abrasive grinding machine defined by claim 1, and further comprising means for varying the spatial distance between the contact roller and the movable surface.

9. The abrasive grinding machine defined by claim 1, wherein said acute angle is approximately 10°–30°.

10. The abrasive grinding machine defined by claim 1, wherein said acute angle is measured in a clockwise direction relative to the line of forward movement of the conveyor belt means.

11. The abrasive grinding machine defined by claim 1, wherein said acute angle is measured in a counterclockwise direction relative to the line of forward movement of the conveyor belt means.

12. In combination:

(a) means for transporting a workpiece, with respect to an abrasive belt, in a first direction;

(b) stationary guidance means for preventing movement of said workpiece in a second direction transverse to said first direction, while enabling movement of the workpiece in the first direction;

(c) and means for causing movement of the abrasive belt, in engagement with a workpiece, to exert force on the workpiece having a major component in said second direction and a minor component in said first direction.

13. A method of grinding the surface of a workpiece using an endless abrasive belt, which comprises:

(a) causing movement of the workpiece in a first direction;

(b) preventing movement of the workpiece with stationary guide means in a second direction transverse to said first direction;

(c) and causing movement of the endless abrasive belt in engagement with the workpiece, to exert force on the workpiece having a major component in said second direction and a minor component in said first direction.

14. A slag grinding machine comprising:

(a) conveyor means comprising an endless belt, a pair of spaced rollers over which said belt travels to define an elongated flat upper working surface therebetween, said working surface having first and second edges and a predetermined longitudinal axis;

(b) means for causing movement of said belt around said rollers so that the working surface carries workpieces therealong;

(c) a fence mounted beside said working surface and extending along said first edge to retainably guide a workpiece moving along said working surface;

(d) a grinding head comprising vertically spaced parallel upper and lower rollers, an endless abrasive belt mounted on said rollers, and means causing movement of said belt around said rollers and axially positioning said abrasive belt therealong;

(e) and means mounting said grinding head above said conveyor means with said lower roller parallel to and spaced from the working surface of said conveyor means, the lower roller having an axis of rotation that is disposed at an acute angle with respect to the longitudinal axis of the working surface;

(f) the direction of movement of said abrasive belt having a minor component longitudinal with respect to the working surface of said conveyor means and a major component transverse to the working surface of said conveyor means and to said fence.

15. A grinder according to claim 14, which further comprises means for varying the spatial distance between said conveyor and the lower roller of said grinding head.

16. A grinding machine according to claim 14, in which said minor component extends in the direction of movement of said working surface.

17. The grinding machine defined by claim 14, wherein said minor component extends in a direction opposite that of the working surface.

18. In combination:

(a) means for transporting a workpiece, with respect to an abrasive belt, in a first direction;

(b) stationary guidance means for preventing movement of said workpiece in a second direction transverse to said first direction, while enabling movement of the workpiece in the first direction;

(c) and means for causing movement of the abrasive belt, in engagement with a workpiece, to exert force on the workpiece having a major component in said second direction and a minor component in a direction opposite the first direction.

19. A method of grinding the surface of a workpiece using an endless abrasive belt, which comprises:

(a) causing movement of the workpiece in a first direction;

(b) preventing movement of the workpiece with stationary guide means in a second direction transverse to said first direction;

(c) and causing movement of the endless abrasive belt in engagement with the workpiece, to exert force on the workpiece having a major component in said second direction and a minor component in a direction opposite the first direction.

20. The abrasive grinding machine defined by claim 1, wherein the movable surface of the endless conveyor belt means is tilted about its longitudinal axis with said first edge disposed below the second edge.

21. The grinding machine defined by claim 14, wherein the working surface of the conveyor means is tilted about its longitudinal axis with said first edge disposed below the second edge.

* * * * *